US008230651B2

(12) United States Patent
Cashman

(10) Patent No.: US 8,230,651 B2
(45) Date of Patent: Jul. 31, 2012

(54) WINDOW FRAME WITH TAPED INSTALLATION FLANGE

(76) Inventor: Daniel J. Cashman, Suffield, CT (US)

( * ) Notice: Subject to any disclaimer, the term of this patent is extended or adjusted under 35 U.S.C. 154(b) by 450 days.

(21) Appl. No.: 12/384,036

(22) Filed: Mar. 31, 2009

(65) Prior Publication Data

US 2010/0242385 A1 Sep. 30, 2010

(51) Int. Cl.
*E06B 3/00* (2006.01)

(52) U.S. Cl. ..... 52/204.55; 52/208; 52/214; 52/745.16

(58) Field of Classification Search ..... 52/204.55, 52/204.56, 204.5, 208, 213, 214, 745.15, 52/745.16

See application file for complete search history.

(56) References Cited

U.S. PATENT DOCUMENTS

| | | | | |
|---|---|---|---|---|
| 2,804,954 | A * | 9/1957 | Gillespie | 52/204.55 |
| 3,090,085 | A * | 5/1963 | Brown | 52/204.591 |
| 3,214,873 | A * | 11/1965 | Davis | 52/513 |
| 3,590,539 | A * | 7/1971 | Brown et al. | 52/209 |
| 4,421,807 | A * | 12/1983 | Clausing et al. | 428/40.3 |
| 4,821,472 | A * | 4/1989 | Tix | 52/204.55 |
| 5,119,609 | A * | 6/1992 | Tait et al. | 52/213 |
| 5,210,986 | A * | 5/1993 | Hagemeyer et al. | 52/211 |
| 5,392,574 | A * | 2/1995 | Sayers | 52/217 |
| 5,590,496 | A * | 1/1997 | Martin et al. | 52/213 |
| 5,701,780 | A * | 12/1997 | Ver Meer | 72/379.2 |
| 5,722,207 | A * | 3/1998 | Anderson et al. | 52/204.55 |
| 7,754,304 | B1 * | 7/2010 | Hohmann, Jr. | 428/40.1 |
| 2006/0137262 | A1 * | 6/2006 | Crowder-Moore et al. | 52/58 |
| 2008/0066400 | A1 * | 3/2008 | Heppner | 52/204.55 |

FOREIGN PATENT DOCUMENTS

DE 20220904 U1 * 7/2004

* cited by examiner

*Primary Examiner* — Brian Glessner
*Assistant Examiner* — Adriana Figueroa
(74) *Attorney, Agent, or Firm* — Alix, Yale & Ristas, LLP

(57) ABSTRACT

A window frame is manufactured as an integral unit comprising a frame body, at least one nailing flange secured to the frame perimeter, and a strip of tape secured to the nailing flanges with the outer portion of the tape extending beyond the outer edge of the flange. In another embodiment, individual nailing flanges are manufactured and delivered on site, including a strip of tape secured to the nailing flange with an outer portion of the tape extending beyond the outer edge of the flange. The installer first secures such pre-taped flanges to the window frame body, before nailing the resulting window frame unit to the wall. With both embodiments, the window frame unit is first fit into the window penetration in the wall, with the nailing flanges and tape overlapping the wall. Each flange is nailed to the wall by folding back the outer, unattached portion of the tape, thereby exposing the nail holes on the flange, and driving nails there though into the wall. The backing on the folded outer portion of the tape is removed, exposing the adhesive side, which is then laid over the remainder of the flange to cover the nails and over a portion of the wall immediately surrounding the outer edge of the flange.

12 Claims, 6 Drawing Sheets

WINDOW FRAME WITH TAPED INSTALLATION FLANGE

BACKGROUND

The present invention relates to building construction and in particular to the framing of doors, windows, and other wall penetrations.

Many residential and some commercial buildings have a clapboard type siding of wood, aluminum, or vinyl, during construction or renovation, that must be trimmed to accommodate a wall penetration where a window box or the like is to be mounted.

Typically, a frame is secured to the wall and surrounds the window box, to provide both a visual enhancement to the window as well as an interface for a clean transition with the siding that surrounds the wall penetration. Especially for installations with vinyl siding, the dimensions and tolerances of the various components are quite liberal, such that tight joints cannot be achieved. To minimize leakage in the finished exterior, it is known to attach strips of a heavy, water proof tape over, e.g., window frame nailing flanges after the flanges with window frame have been secured to the wall.

SUMMARY

The object of the present invention is to eliminate the installer's task of on-site taping of such nailing flanges, by providing pre-taped flanges.

The tape is partly secured to the flange, with an outer portion of the tape extending over and beyond the outer portion of the flange with the backing intact.

In one embodiment, the window frame is manufactured and delivered on site as an integral unit comprising a frame body defining a closed perimeter, at least one nailing flange secured to the frame perimeter, and a strip of tape secured to the nailing flanges with the outer portion of the tape extending beyond the outer edge of the flange.

In another embodiment, individual nailing flanges are manufactured and delivered on site, including a strip of tape secured to the nailing flange with an outer portion of the tape extending beyond the outer edge of the flange. The installer first secures such pre-taped flanges to the window frame body, before nailing the resulting window frame unit to the wall.

With both embodiments, the window frame unit is first fit into the window penetration or opening in the wall, with the nailing flanges and tape overlapping the wall. Each flange is nailed to the wall by folding back the outer, unattached portion of the tape, thereby exposing the nail holes on the flange, and driving nails there through into the wall. The backing on the folded outer portion of the tape is removed, exposing the adhesive side, which is then laid over the remainder of the flange to cover the nails and over a portion of the wall immediately surrounding the outer edge of the flange.

The first embodiment is preferably implemented in conjunction with a window frame comprising a frame body defining a closed perimeter, the body having front and back faces and inner and outer edges with the outer edges defining a frame perimeter. A channel extends along the outer edge of the frame body and mounting strips are located in the channel, thereby providing a mounting flange around the perimeter of the frame. Once the frame is mounted to the wall through the flange, siding is aligned with the outer edges of the frame and attached to the wall, covering and thus hiding the flange.

Whether intended for use with wood or other siding, the frame has a channel closer to the back face, having a thickness less than the thickness of the siding, for accommodating the flange.

For use with vinyl siding, primary and secondary channels are provided around the periphery of the frame, whereby the side edges of siding elements can be slid laterally into the primary channel and flanges can be secured within the secondary channels. Thereafter the siding elements can be inserted into the primary channels to finish the installation.

In yet another aspect, the invention is directed to a method of affixing a window frame around a window penetration or box in a flat wall before siding panels are affixed to the wall. The method comprises placing the window frame around the window box, with the back face of the frame against the wall. For any bare mounting flange not having attached tape, the bare flange is affixed to the wall. For each mounting flange having attached tape, the outer portion of the tape is folded upward to expose the underlying outer portion of the flange so that the outer portion of the flange can be affixed to the wall. After affixing each mounting flange having attached tape to the wall, the outer portion of the tape is folded and smoothed downward to sealingly cover the outer portion of the flange and adjacent wall. sequentially placing said panels against the wall, over said tape, and into or against the outer edges of the taped frame elements. The panels are then affixed to the wall.

DETAILED DESCRIPTION

Figure 1:
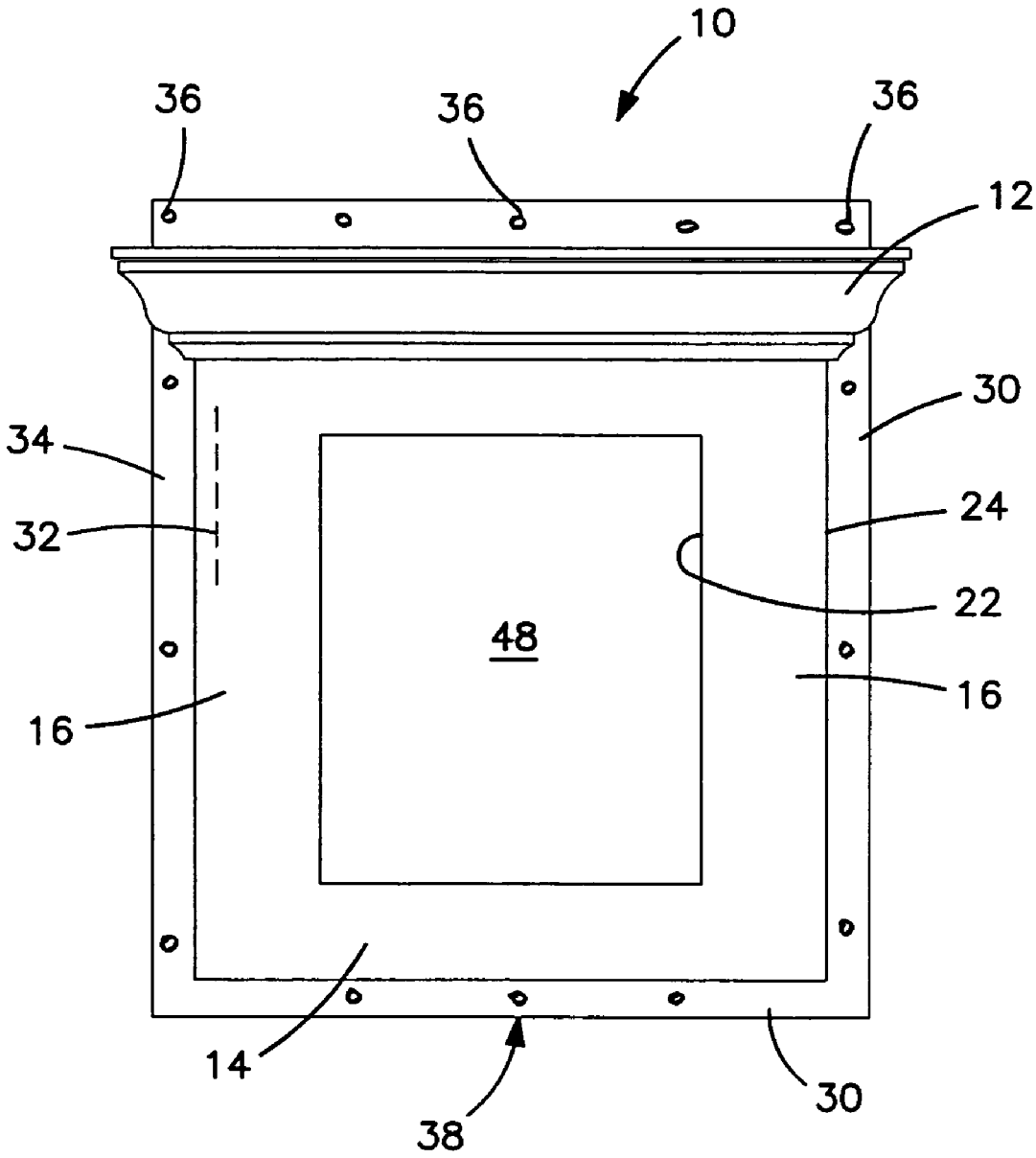
FIG. 1 is a front view of a window frame placed over a wall penetration prior to attachment of the frame to the wall.
Figure 2:
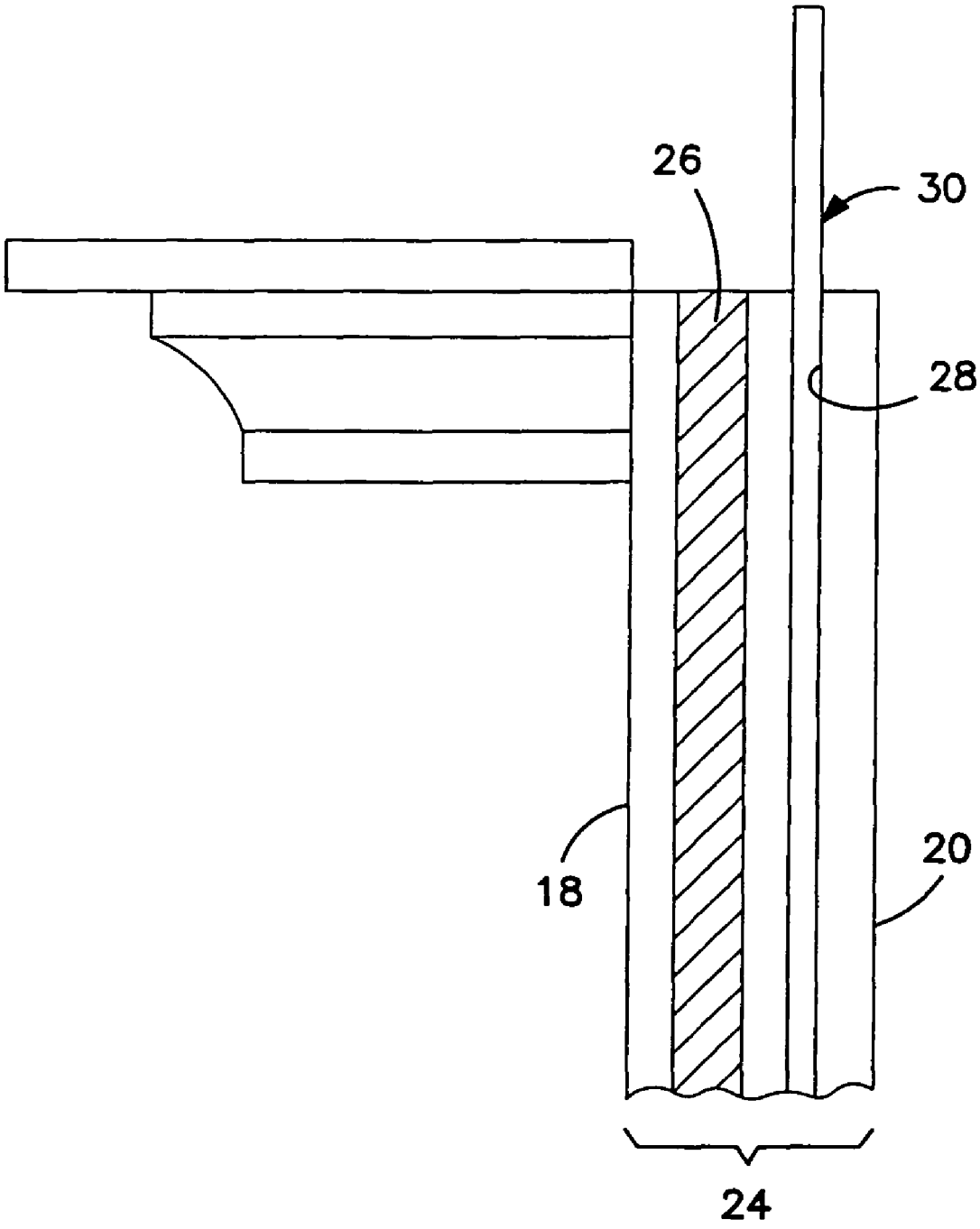
FIG. 2 is a side elevation view of the upper portion of the window frame of FIG. 1 showing the primary channel for receiving the edges of siding panels and a elongated strip in a secondary channel, forming a portion of the mounting flange for the frame.

FIGS. 1 and 2 show a prefabricated window frame 10 especially adapted for use with vinyl wall siding, having a top element 12, a bottom element 14, and side elements 16 connected together to define a rectangular frame around opening 48, each element having front 18 and back 20 faces, and inner 22 and outer 24 edges, whereby the outer edges define the frame perimeter. At least the side elements 16, and preferably all the elements have a primary channel 26 extending along the outer edge, and a secondary channel 28 extending along the outer edge between the primary channel 26 and the back face 20. Preferably, but not necessarily, the primary channel is situated closer to the front face 18, than to the secondary channel 28.

In the fully prefabricated embodiment shown in FIG. 1, a mounting strip 30 has an inner edge 32 (shown in phantom) extending through the secondary channel of each element, and an outer edge 34 outside the perimeter of the frame. Each mounting strip preferably includes a plurality of holes 36 for receiving mounting hardware such as nails or screws driven into the wall surrounding the wall penetration or window box to be surrounded by the frame. Preferably, the mounting strips are plastic (vinyl) and have a thickness which requires some degree of compression when slid into the secondary channels, producing an interference fit. Alternatively, mounting brackets or similar structures (not shown) can be located in the channels for positive engagement of the strips. In the preferred embodiment shown in FIG. 1, the strips form a flange surrounding the window box or penetration in the wall.

Preferably, the primary channel 26 is wider than the secondary channel 28, because the thickness of the flange 30 is typically about 1/16 inch, whereas the butt end of the siding elements or panels to be received in the primary channel 26 is wider and needs to be accommodated in a channel that is about 3/4 inch. The primary channel should be slightly wider than the butt of vinyl siding to allow for expansion. If used for wood siding, the primary channel can be eliminated, because the wood siding would typically be cut tight and caulked. The strip mounting channel would be less than about 1/8 inch in width, closer to the back face of the frame.

Figure 3:
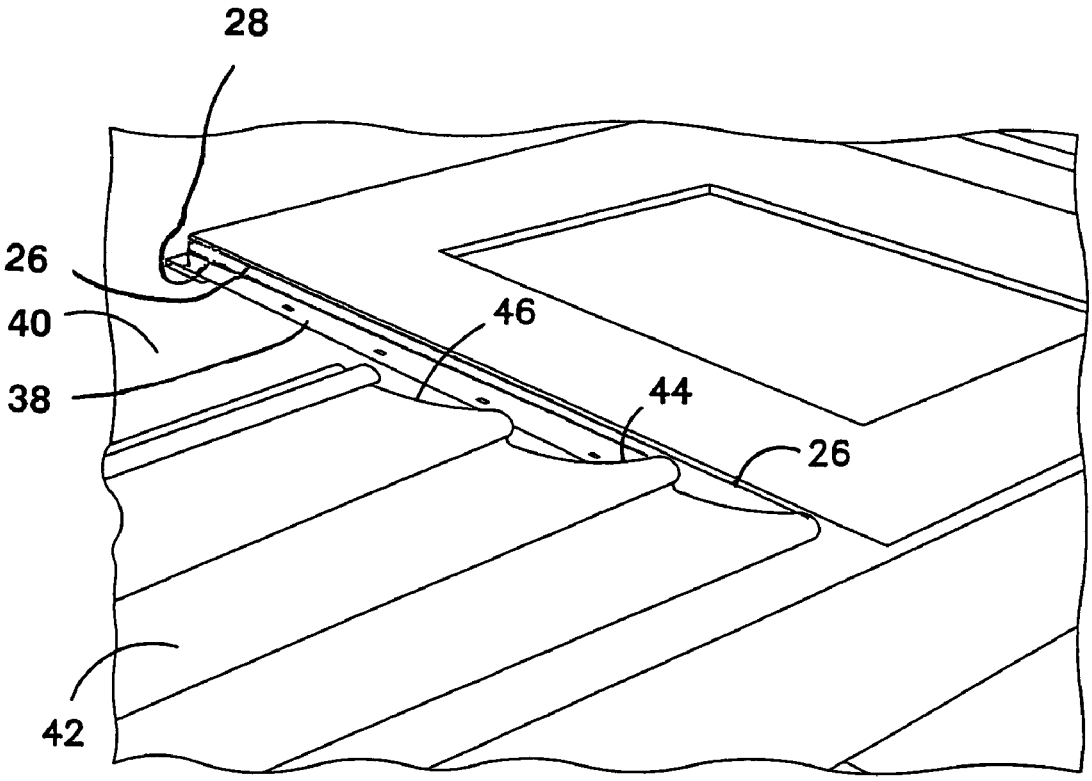
FIG. 3 is an oblique view of the frame with flange during the process of inserting the end edges of the siding panels into the primary channel of one side element of the frame.

With reference also the FIG. 3, the method of installation for use with vinyl siding will be described in greater detail. The frame can either be prefabricated with the flange as shown in FIG. 1, or the frame can be shipped to the installation site with the strips as separate components. Whether prefabricated as an entire unit, or assembled on site as such unit, the frame with strips and/or complete flange 38 are placed around the window box or similar penetration with the back face 20 of the frame against the wall 40. The flange is then affixed to the wall, such as by nailing through holes 36 to arrive at the condition shown in FIG. 1. To accommodate the subsequent attachment of the siding 42 to the wall 40, the longitudinal and seams 44 and end edges 46 of the panels are slid into the primary channel 26 of each frame element.

Figure 4:
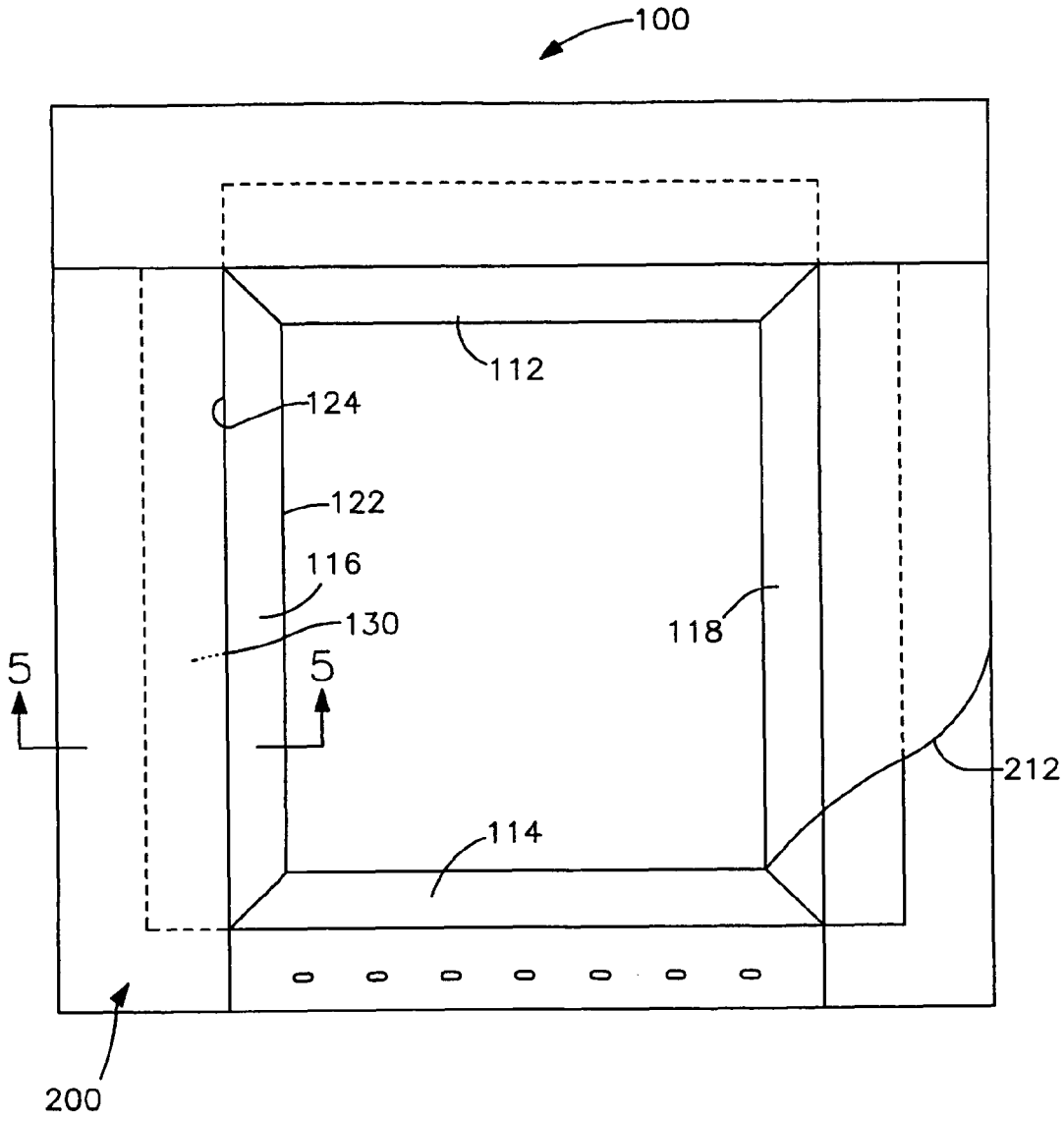
FIG. 4 is a front view of the window frame of FIG. 1 before installation, showing the waterproofing tape as delivered and as would be folded back during nailing of the flange.
Figure 5:
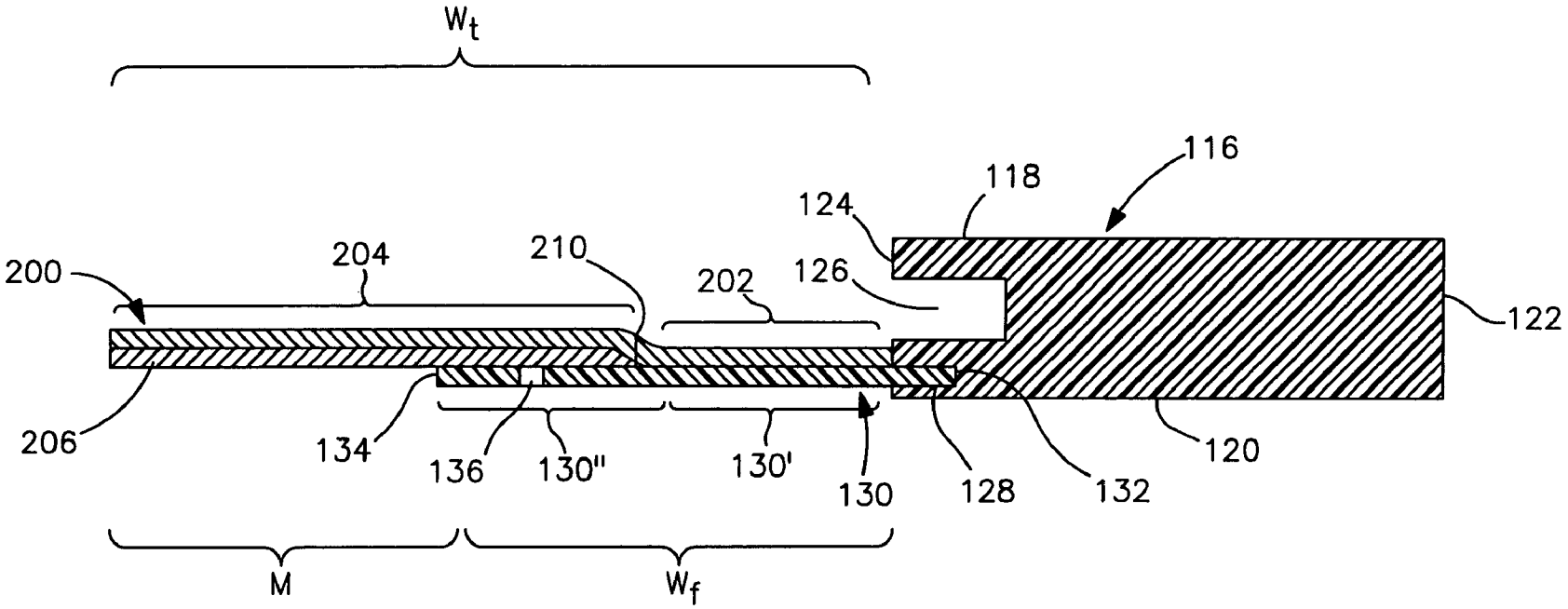
FIG. 5 is a cross section view taken through line 5-5 of FIG. 4.

One embodiment of the present invention is represented in detail in FIGS. 4 and 5. Numeric ID's 120, 122, 124, 126 and 128 in FIGS. 4 and 5 correspond respectively to numeric ID's 20, 22, 24, 26 and 28 in FIGS. 1 and 2. At least one flange 130, and preferably all flanges, carry a strip 200 of waterproof tape. The width Wt of the tape is generally greater than the width Wf of the flange, preferably Wt>2*Wf, and typically in the range of about three to five inches. The tape 200 is longitudinally divided into an inner tape portion 202 that is adhesively attached to the inner portion 130' of the flange, and an outer tape portion 204 with backing 206 intact, that overlies the outer portion 130" of the flange and defines a margin M that extends beyond (overhanging) the outer edge 134 of the flange.

The longitudinal dividing line 210 on the tape is formed during fabrication of the unit 100, when the backing on a raw piece of tape is slit lengthwise and one side is removed to so that the adhesive on the back of the waterproof film is exposed, thereby permitting the fabricator to attach the inner portion 202 to the inner portion 130' of the flange. The dividing line must be on the inside of the holes 136, so that the holes can later be uncovered during installation. Stated differently, the holes 136 must be under the outer portion 204 of the tape.

In the embodiment of FIGS. 4 and 5, the window frame is manufactured and delivered on site as an integral unit 100 comprising a frame body 112, 114, 116, 118 defining a closed perimeter, at least one nailing flange 130 secured to the frame perimeter, and a strip of tape 200 secured to the nailing flanges with a margin M of the tape extending beyond the outer edge of the flange.

Figure 6:
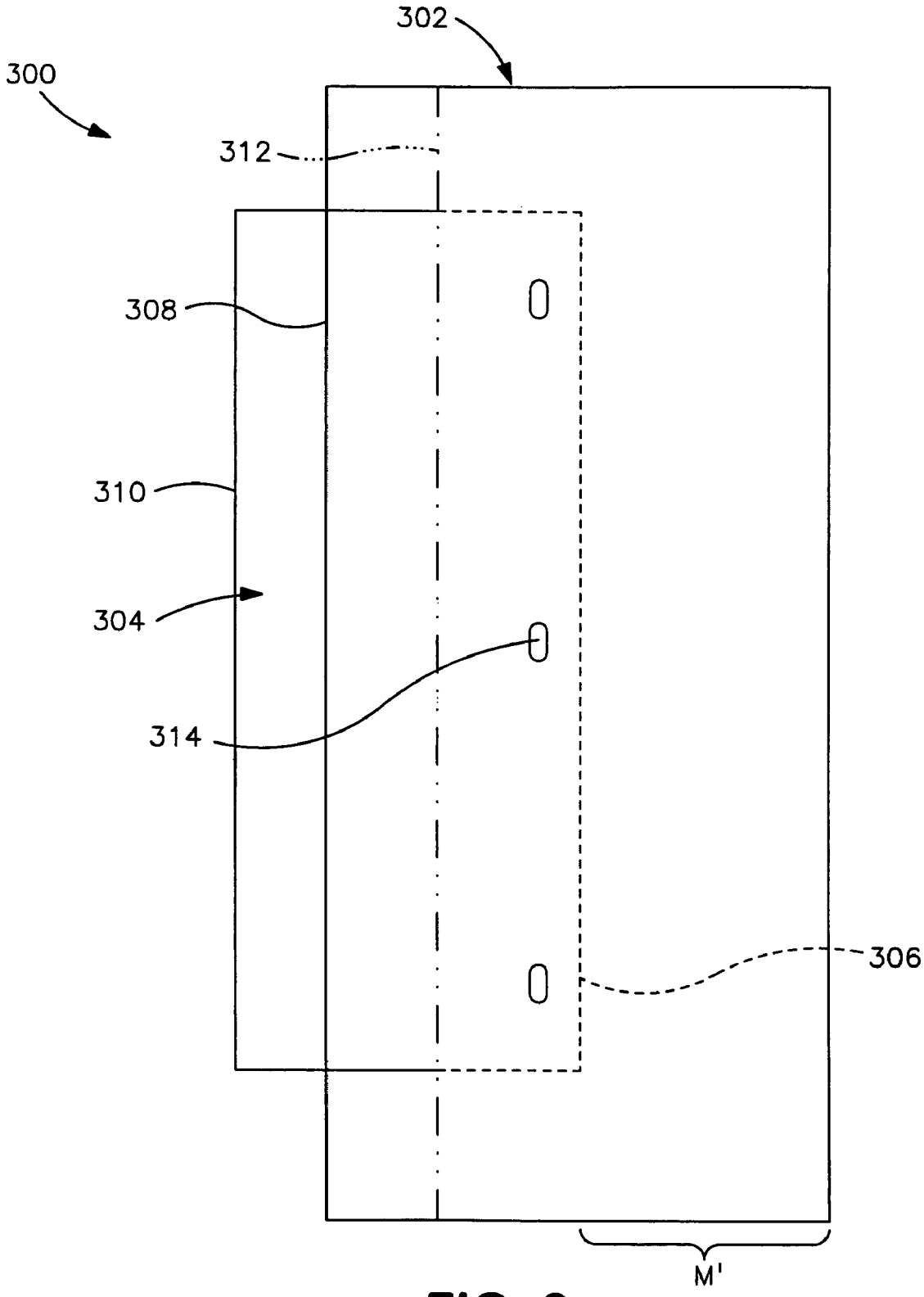
FIG. 6 shows a pre-taped nailing flange as would be delivered to the job site for insertion into a window frame before installation.

In the embodiment of FIG. 6, individual, pre-taped nailing flanges 300 are manufactured and delivered on site, including a strip of tape 302 secured to the nailing flange 304 with a margin M' of the tape extending beyond the outer edge 306 of the flange. It should be appreciated that the inner edge 308 of the tape can be aligned with or spaced outwardly (as shown) from the inner edge of the flange. As with the previously described embodiment, the dividing line 312 between the inner and outer portions of the tape is located inwardly of the nail holes 314, so the outer portion of the tape can be folded upwardly during installation. The installer first secures such pre-taped flanges to the window frame body, before nailing the resulting window frame unit to the wall.

With reference again to FIGS. 4 and 5, with both embodiments the window frame unit such as 100 is first fit into the window penetration or opening in the wall, with the nailing flanges 130 and tape 200 overlapping the wall. Each flange is nailed to the wall by folding back the outer portion 204 of the tape, such as indicated at 212, thereby exposing the nail holes 136 on the flange, and driving nails there though into the wall. The backing 206 on the outer portion of the tape is removed, exposing the adhesive side, which is then laid over the outer portion 130" of the flange to cover the nails and over a portion of the wall immediately surrounding the outer edge of the flange, i.e., under the margin M.

After the frame unit 100 has been affixed to and taped against the wall, a first panel is placed against the wall and inserted with either a longitudinal edge at the seam 44, or an end edge 46, into a primary channel. Typically, the first side panel would be at the bottom 14 of the frame with a longitudinal seam inserted within the longitudinal channel associated with the bottom element. Subsequent panel elements would be connected to each other in vertical sequence and likewise the end seams and edges including ends of the seams would be inserted into the primary channel of the side element 16 of the frame. This process would continue with subsequent end edges 44 or 46 until the top 12 of the frame is reached, where upon another longitudinal seam 44 may or may not be inserted into the corresponding primary channel in the top element, depending on the spacing of the seams and the size and location of the frame relative to the initial panel inserted in the bottom element 14.

It should be appreciated that a non-taped flange in a frame element can be removed and replaced by a pre-taped flange, or a pre-taped flange can be removed and replaced by different pre-taped flange having additional holes to receive extra fasteners.

The invention is also usable with wood siding, but as discussed above, only one channel 128, for the flange strips 130, is required.

What is claimed is:

1. A stand-alone window frame unit intended to be installed around an opening in a building wall, comprising:

a plurality of frame elements connected together to define a closed frame body, each element having front and back faces intended to be substantially parallel to said building wall and inner and outer edges whereby the outer edges define the frame perimeter;

a mounting flange secured along the outer edge of at least some of the frame elements, each said mounting flange having an outer edge extending beyond the outer edge of the respective frame element; and a strip of waterproof tape attached to at least some of the mounting flanges, having an inner tape portion that is attached to the flange, and an outer tape portion with removable backing, defining a tape margin that extends beyond the outer edge of the flange;

wherein the flange has a front, a back, and an outer portion including nail holes and the tape inner portion is adhesively attached to an inner portion of the front of the flange such that the outer portion of the tape with backing covers the holes and extends beyond the outer edge of the flange.

2. The window frame unit of claim 1, wherein each mounting flange has a front, back and width Wf and each strip of tape has a width Wt at least twice the width Wf, and the inner tape portion is attached to the front of the flange.

3. The window frame unit of claim 1, wherein the tape has a width Wt of at least about five inches.

4. The window frame unit of claim 1, wherein each mounting flange has a width Wf and each strip of tape has a width Wt at least twice the width Wf.

5. The window frame unit of claim 1, wherein the tape has a width Wt of at least about three inches.

6. A stand-alone window frame unit intended to be installed around an opening in a building wall comprising:

top, bottom, and opposed side frame elements connected together to define a rectangular frame, each element having front and back faces intended to be substantially parallel to said building wall and inner and outer edges whereby the outer edges define the frame perimeter;

a respective mounting flange secured in a first channel extending along the outer edge of each of the side elements, closer to the back face than to the front face, each said mounting flange having an outer edge extending laterally beyond the outer edge of the respective side frame elements;

a strip of waterproof tape attached to each mounting flange on the side elements, having an inner tape portion that is adhesively attached to the flange, and an outer tape portion with removable backing, defining a tape margin M that extends beyond the outer edge of the flange;

wherein the inner portion of the tape is adhesively attached to an inner portion of the flange, inside the nail holes, and the outer portion of the tape with backing, covers the holes and extends beyond the outer edge of the flange.

7. The window frame of claim 6, wherein one of the mounting flange with attached strip of tape extends along each frame element.

8. The window frame of claim 6, wherein a second channel extends along the outer edge of each of said side elements, closer to the front face than to the back face, and having a width greater than the width of the first channel.

9. The window frame of claim 8, wherein said first and second channels extend along the outer edge of each frame element, said mounting flange is secured in each of the first channels, and a strip of said tape is secured to each mounting flange.

10. The window frame of claim 6, wherein each mounting flange includes a plurality of holes in an outer portion for receiving mounting nails.

11. The window frame of claim 6, wherein the mounting flanges are vinyl.

12. A method of affixing a window frame around a window box in a flat wall before siding panels are affixed to the wall, comprising:

(a) selecting a window frame having (i) a plurality of frame elements connected together to define a closed frame, each element having front and back faces and inner and outer edges whereby the outer edges define the frame perimeter, (ii) a mounting flange secured along the outer edge of at least some of the frame elements, each said mounting flange having an outer edge extending beyond the outer edge of the respective frame element; and (iii) a strip of waterproof tape attached to at least some of the mounting flanges, having an inner tape portion that is attached to the flange, and an outer tape portion with removable backing covering an outer portion of the flange and extending beyond the outer edge of the flange;

(b) placing the window frame around the window box, with the back face of the frame against the wall;

(c) for any bare mounting flange not having attached tape, affixing the bare flange to the wall;

(d) for each mounting flange having attached tape, folding the outer portion of the tape upward to expose the underlying outer portion of the flange and affixing the outer portion of the flange to the wall;

(e) after affixing each mounting flange having attached tape to the wall, folding the margin of the tape downward to sealingly cover the outer portion of the flange and adjacent wall; and (f) sequentially placing said panels against the wall, over said tape, and into or against the outer edges of the taped frame elements; and (g) affixing the panels to the wall.

* * * * *